US006910926B1

(12) United States Patent
Yamada

(10) Patent No.: US 6,910,926 B1
(45) Date of Patent: Jun. 28, 2005

(54) ELECTRONIC CONNECTOR TERMINAL

(75) Inventor: Shoji Yamada, Tokyo (JP)

(73) Assignee: Quasar System, Inc., Yamato (JP)

( * ) Notice: Subject to any disclaimer, the term of this patent is extended or adjusted under 35 U.S.C. 154(b) by 0 days.

(21) Appl. No.: 10/796,624

(22) Filed: Mar. 9, 2004

(51) Int. Cl.[7] ..... H01R 9/24
(52) U.S. Cl. ..... 439/886
(58) Field of Search ..... 439/886, 427, 439/857, 856; 29/874; 257/687, 668

(56) References Cited

U.S. PATENT DOCUMENTS 5,011,256 A * 4/1991 Johnson et al. ..... 385/92
5,173,766 A * 12/1992 Long et al. ..... 257/687
6,488,550 B1 * 12/2002 Kikuchi et al. ..... 439/857
6,679,709 B2 * 1/2004 Takeuchi ..... 439/83
6,789,308 B2 * 9/2004 Takaba et al. ..... 29/600
6,790,047 B2 * 9/2004 Togashi ..... 439/63

* cited by examiner

*Primary Examiner*—Ross Gushi
*Assistant Examiner*—Phuongchi Nguyen
(74) *Attorney, Agent, or Firm*—Malloy & Malloy, P.A

(57) ABSTRACT

The present invention provides an electronic connector terminal. The electronic connector terminal according to the present invention comprises a terminal base material 2 which is formed by punching a thin metal plate and an Au plating layer 17 which covers the terminal base material 2. The terminal base material 2 is defined by a cut surface of the thin plate through punching and comprises a lateral part 4 having at least one contact 6, planer parts 5 defined by front and back faces of a punched-out piece. An Au plate layer 17 on the planer parts 5 has the thickness being thinner than the thickness of an Au plate layer 17 on the lateral part 4 having at least one contact 6.

5 Claims, 4 Drawing Sheets

(a)

(b)

ELECTRONIC CONNECTOR TERMINAL

BACKGROUND OF THE INVENTION

1. Field of the Invention

The present invention relates to an electronic connector terminal, and particularly relates to an electronic connector terminal produced by punching a thin metal plate in a desired shape followed by plating with Au.

2. Description of the Related Art

An electronic connector terminal is generally formed by punching an electrically conductive thin plate to a predetermined shape. Such an electronic connector terminal usually comprises planer parts defined by front and back faces of a punched out piece and lateral parts defined by a cut-out plane through punching of the thin plate. Generally the electronic connector terminal is categorized to two kinds of terminals; one is a terminal disposed such that the planer part of the thin plate includes a connection to the connection housing when inserted to a connector housing, and another is a terminal disposed such that the lateral part includes a connection to the connector housing when inserted to a connector housing. The terminal, which is configured to have the connection point on the lateral part, has advantages in which the terminal is easier to maintain contact pressure required to the terminal than the terminal configured to have connection point on the planer part and in which the terminal can be disposed in a narrow pitch.

Generally, an electronic connector terminal is applied with plating on surfaces of the terminal so as to prevent degradation of connecter performance due to oxidation under atmosphere of usage circumstance or electric contact mechanism while enhancing electrical conductivity. Conventionally, in the terminal configured to have the electronic connection on the lateral part, the electronic plating is provided on the entire surface of the terminal, and therefore, there is a drawback in which significant amounts of gold (Au) used for plating thereof are required so that the product cost thereof becomes high.

With respect to the above drawback, the terminal with plating only on the connection point of the lateral part has been proposed. For example, the method comprising the following steps has been proposed in Japanese Patent (Laid-Open) No. Showa 49-114796 and the steps are:

stacking a plurality of connector terminals; and plating thereon such that un-necessary plating layers can not be deposited on planer parts of a fork-shaped spring.

The planer part may be oxidized during long terms usage and the connector performance thereof may be degraded even though the planer part is not subjected to the circumstance easy to be oxidized than the circumstance of the lateral part. With respect to this problem, a contact element with covered planer part with an insulation film has been proposed in Japanese Utility Model (Laid-Open) No. Heisei 5-90834. This contact element is formed by masking the part on which the insulator film is not deposited, and thereafter, dipping the contact in fluorine-system resin solution to form the insulation film thereon.

However, the above process requires a masking step in which the contact including the plating layer must be masked after Au plating of the contact portion followed by dipping in the fluorine-system resin solution thereby increasing product costs because additional production processes are required and process steps are increased while wasting time and elaboration as well as requirements for masking materials and the fluorine-system resin solution.

Therefore, a terminal which is produced easily and inexpensively by reducing amounts of Au necessary for plating without requiring additional production processes are required so far.

SUMMARY OF THE INVENTION

Regarding the above problem, an object of the present invention is to provide an electronic connector terminal which is produced easily and inexpensively by reducing the amount of Au necessary for plating without requiring additional production processes, and maintaining sufficient contact pressure even when the terminal width is narrowed.

The above object may be achieved by providing the electronic connector terminal according to the present invention. That is, according to the invention of claim 1, an electronic connector terminal may be provided. The terminal comprises a terminal base material formed by punching a metal thin plate and an Au plating layer covering the terminal base material, the terminal base material further comprising a lateral part having at least one contact and defined as a cut surface of the thin plate through the punching and a planer part defined by front and back faces of a punched-out piece of the thin plate, wherein a thickness of an Au plating layer covering the planer part is thinner than a thickness of an Au plating layer covering the lateral part having the at least one contact.

According to the invention of claim 2, the electronic connector terminal may be provided in which the terminal is characterized in that a ratio of the thickness of the Au plating layer covering the lateral part and the thickness of the Au plating layer covering the planer part is to be from about 10:1 to 5:1.

According to the invention of claim 3, the electronic connector terminal may be provided in which the electronic connector terminal comprises a liner plating layer formed between the terminal base material and the Au plating layer so as to cover the terminal base material.

According to the invention of claim 4, the electronic connector terminal may be provided in which a thickness of a liner plating layer covering the planer part is thinner than a thickness of a liner plating layer covering the lateral part having the at least one contact.

According to the invention of claim 5, the electronic connector terminal may be provided in which a ratio of the thickness of the liner plating layer covering the lateral part and the thickness of the liner plating layer covering the planer part is to be from about 10:1 to 5:1.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
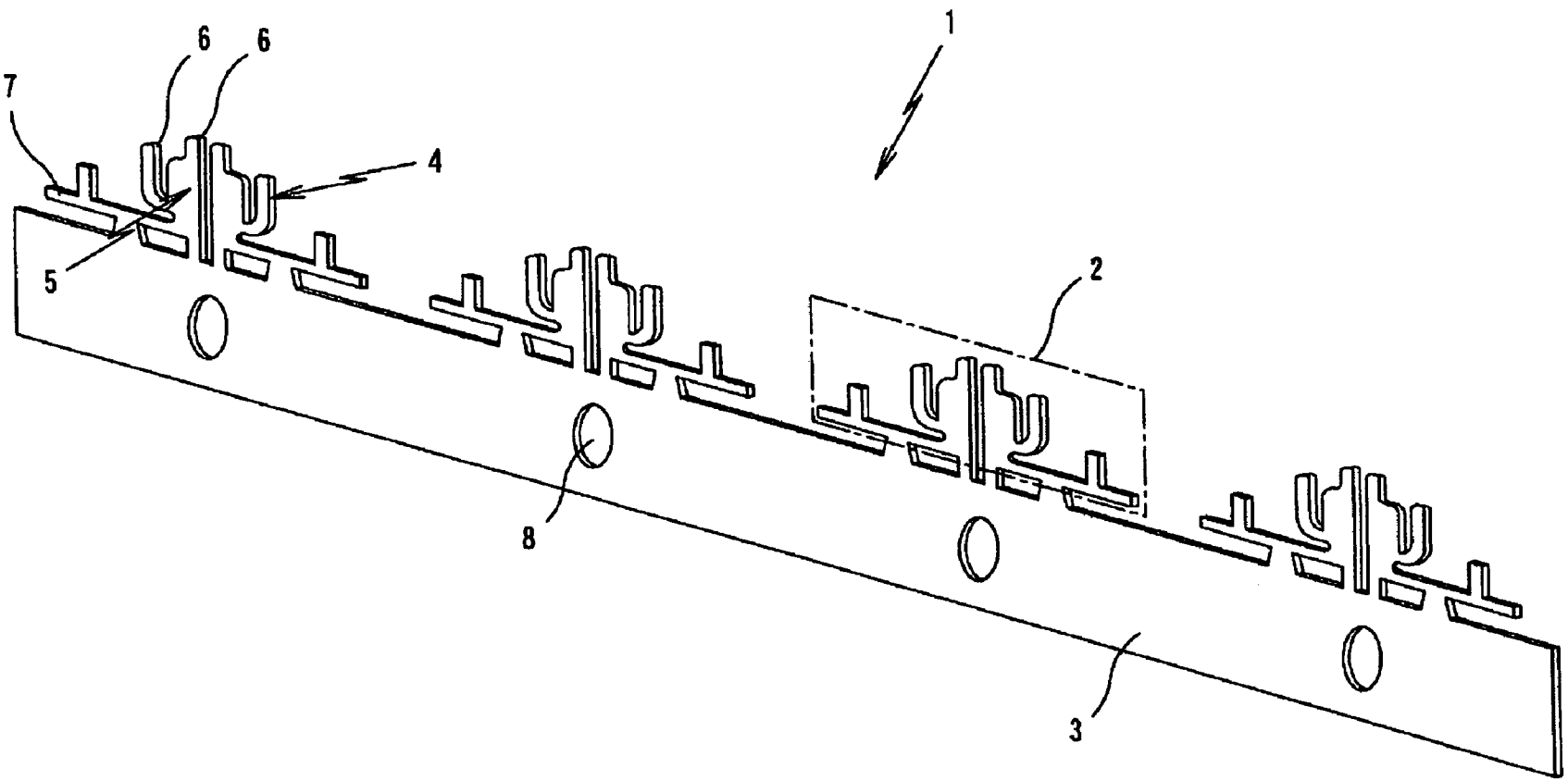
FIG. 1 shows a perspective view of the terminal stack which is formed by connecting plural electronic connector terminal of the present invention.

Now, the present invention will be explained in detail with reference to the accompanying drawings, however, the present invention is not intended to be limited to the particular embodiments described hereinafter. FIG. 1 shows a perspective view of the terminal stack. The terminal stack 1 has a structure that a plurality of terminal base materials 2 are integrated to one carrier 3. Each terminal base material 2 is formed by punching a metal thin plate. The electronic connector terminal of the present invention is produced by subjecting the terminal stack 1 to Au plating and thereafter cutting the carrier 3 to separate individual base materials. Here, the term "terminal base material" is defined as a terminal part formed by punching the thin plate prior to Au plating except for the carrier 3. The terminal base material 2 comprises a lateral part 4 formed by a cut surface by punching the thin plate and a planer part 5 formed as front and back faces of the punched piece. A contact 6 is disposed to one end of the lateral part 4 and the contact 6 is urged by pressure to a connection terminal of an electrical member (not shown). In the embodiment shown in FIG. 1, two contacts 6 are provided. In addition, a leg part 7, which is to be soldered to a substrate to which an electric connector (not shown) is placed, extends from the lateral part 4 of the terminal base material 2.

Figure 2:
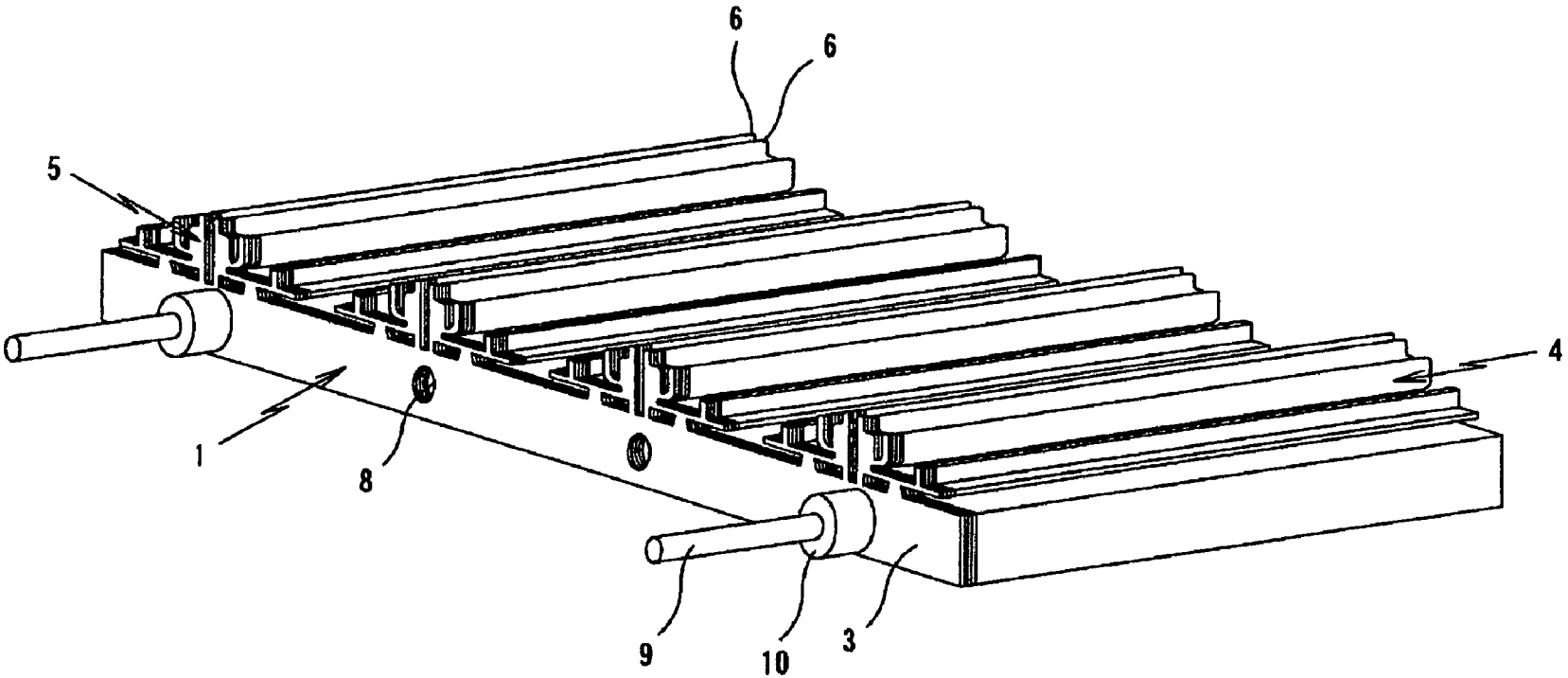
FIG. 2 shows a ply of the plural terminal stacks.

The thin metal plate used as the terminal base material 2 shown in FIG. 2 may include copper alloy such as helium-copper and phospher bronze or electrically conductive metal such as aluminum with the thickness thereof between 0.1 mm and 0.3 mm. A shape through the punching press may be determined depending on a shape of a connection terminal.

Holes 8 for carriage are formed in the carrier 3 with a predetermined spacing in therebetween as shown in FIG. 1 so as to insert a carrier bar (not shown) therethrough with adequate flexibility. The electronic connector terminal of the present invention is generally produced by the steps of: plural terminal stacks 1 are plied, thereafter the carrier bars are inserted into the carrier holes 8 so as not to come off the terminal stacks from the carrier bar, then the plating process described below is subjected thereto, the Au plating layer is formed on each of the plurality of the terminal base materials 2, and then the terminal stack 1 is cut apart from the carrier 3 to provide individual terminals. Then each of the terminals is inserted to a connector housing.

In the present invention, a liner plating layer such as a nickel plating layer may be disposed between the thin metal plate and the Au plating layer. The liner plating layer may be deposited to cover the terminal base material 2. The nickel plating may be used to provide gloss effect and to harden the plating surface as well as to provide anti-oxidation effect for the thin metal plate.

The electronic connector terminal of the present invention is covered by the Au plating layer in the entire portion thereof, however, a thickness of the Au plating layer covering the planer part 5 becomes thinner than a thickness of the Au plating layer covering the lateral part 4. The reason why the Au plating layer covering the planer part 5 becomes thinner to prevent degradation of connector performance due to gradual oxidation while the planer part 5 is placed in a less oxidation atmosphere than the lateral part 4 comprising the contact 6 which are placed in a greater oxidation atmosphere due to electronic contact. The additional reason is to lower the production cost by reducing amounts of Au plating deposited on the planer part 5 having a wide area. It may be possible to reduce degradation of the connector performance by forming an insulation film on the planer part 5. However, the above method would add to the process for masking the lateral part 4 which has already been applied with Au plating and depositing the insulation film thereon would require additional materials and apparatus being necessitated, thereby increasing the production processes and failing to lower the production costs. The electronic connector terminal of the present invention makes it possible to provide the Au plating on the planer part 5 at the same time the Au plating to the lateral part 4 is applied, wherein the thickness of the Au plating on the planer part 5 becomes thinner than that of the lateral part 4. Therefore, the terminal will be provided inexpensively without the additional processes and the additional materials.

In the present invention, when the liner plating layer is applied, the liner plating layer between the terminal base material 2 and the Au plating layer may be the same thickness as the Au plating layer. However, the liner plating layer may be formed such that the thickness thereof covering the planer part 5 becomes thinner than that of the lateral part 4. According to the present invention, it is preferable to form the thickness of the liner plating covering the planer part 5 thinner than that on the lateral part in order to provide the terminals inexpensively.

Now, the method for forming the Au plating layer to the electronic conductive terminal according to the present invention will be described. FIG. 2 shows the situation in which the terminal stacks 1 are plied and the carrier bars 9 are inserted into the holes 8. The planer part 5 and the plane of carrier 3 of the terminal in each of the terminal stacks 1 are adjacent each other and only the planer part 5 and the plane on the carrier 3 of the outermost terminal stack 1 are exposed freely to the plating solution. Here, the plane of the carrier 3 is defined as the front and back planes of the carrier 3 and the lateral part of the carrier is defined as faces along to the thickness of the carrier 3. In the described embodiment in FIG. 2, the fixing member 10 is disposed in a predetermined position on the carrier bar 9 after inserting the carrier bar 9 into the holes 8 of the terminal stack 1 so as not to come off from the carrier bar 9.

When the terminal stacks 1 supported by the supporting member 10 after insertion of the carrier bar 9 are dipped in plating solution as is, Au plating layers are prevented from being deposited on the adjacent planer part 5 and the outermost planes of the carrier 3 except for the outermost planer part 5 and the plane of the carrier 3. In the present invention, the inventor found that the thinner Au plating layer can be formed on the planer part 5 by dipping the terminal stacks 1, moving the terminal base material such that the planer part of each of the terminal base materials 2 is exposed to the Au plating solution by being immersed in the plating solution allowing it to penetrate between the plied terminal stacks.

Figure 3:
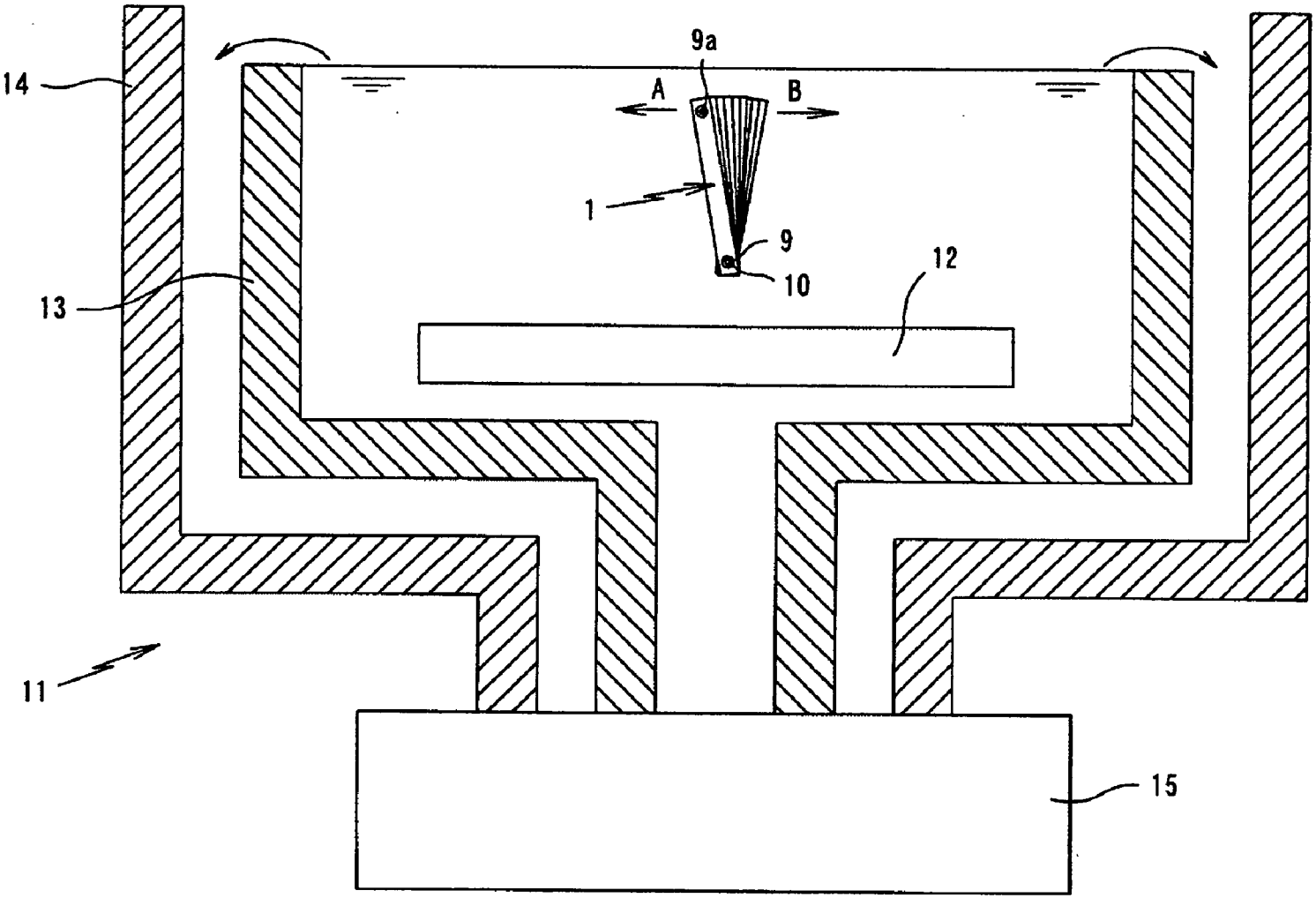
FIG. 3 shows an Au plating process where plural terminal stacks are dipped in a plating bath.

The above method will be described in detail by referring to FIG. 3. The method for applying Au plating may include in the present invention, such as, for example, an electric plating method using an overflow-type plating bath; however, chemical plating methods may not be excluded in the scope of the present invention. The plating bath 11 comprises a plating-processing bath 13 in which an anode 12 is disposed in the bottom thereof. A recover bath 14 is placed around the plating-processing path 13 for recovering plating solution overflowed from the plating-processing bath 13. A control bath 15 is provided for sending the plating solution by pressure to the plating-processing bath 13 and for sending the plating solution by pressure from the recovery bath 14 to the plating-processing bath 13. The plating bath 11 is designed to keep the plating solution level at a predetermined solution level while overflowing from the plating-processing bath 13.

Next, the plural plied terminal stacks 1 are connected to a cathode, and then are dipped into the plating solution in the plating bath 11. Thereafter, the one end 9*a* of the carrier bar 9 is inserted through the terminal stacks 1 and is caused to make round trip movements along with a predetermined direction in a predetermined frequency. For example, when the plural terminal stacks 1 are plied using two carrier bars 9, one carrier bar may be fixed and then only one end 9*a* of another carrier bar are caused to make the round trip movements so that each of the terminal stacks 1 may make the round trip movement. As shown in FIG. 3, when the one end 9*a* is moved to the direction of the arrow A, the plural terminal stacks 1 spread like a fan, and a region of the planer parts of the terminal base material and a region of the plane of the carriers are exposed to the plating solution. Further next, when moved to the arrow B which is in the inverse direction to the arrow A, the plural terminal stacks 1 spread like a fan again and contact the adjacent terminal stacks 1 such that the plating solution on the surface of the planer part is extended as thin layers to penetrate towards the entire surface of the planer part. When the movements are repeated, the thin Au plating layer on the entire planer part 5 may be deposited. The lateral parts are always exposed to the plating solution, and then the thicker plating layer than the planer part 5 and the plane of the carrier 3 may be formed.

In the present invention, the opposite end to the end 9*a* may be caused to make round trip movements in the opposite direction of the end 9*a* rather than moving only one end 9*a*. Alternatively, the another carrier bar may be caused to make round trip movements simultaneously such that faces exposed to the plating solution are increased so as to form thin Au plating layer effectively on the entire planer parts.

In the present invention, plural terminal stacks 1 are formed by punching thin metal plate, followed by plying the plural terminal stacks 1, further followed by inserting the carrier bar 9 to the holes, and further next the plural terminal stacks 1 are supported to the carrier bar 9 by the fixing member 10 such that the terminal stacks 1 does not come off from the carrier bar 9. Then the terminal stacks 1 are washed by acid including, for example, diluted HCL or diluted $H_2SO_4$ between 1 to 5 vol % and further next are dipped into Ni plating solution to deposit the liner Ni plating layer. In the steps of acid-washing and liner Ni plating layer formation, the acid may be penetrated to the planer parts 5 of the terminal stacks 1 and the liner plating solution may also be penetrated to the planer parts 5 of the terminal stacks 1 by reciprocal movements of the carrier bar 9 such that the thickness of the liner plating layer covering the planer part 5 may be thinner than the thickness of the liner plating layer covering the lateral part 4.

Figure 4:
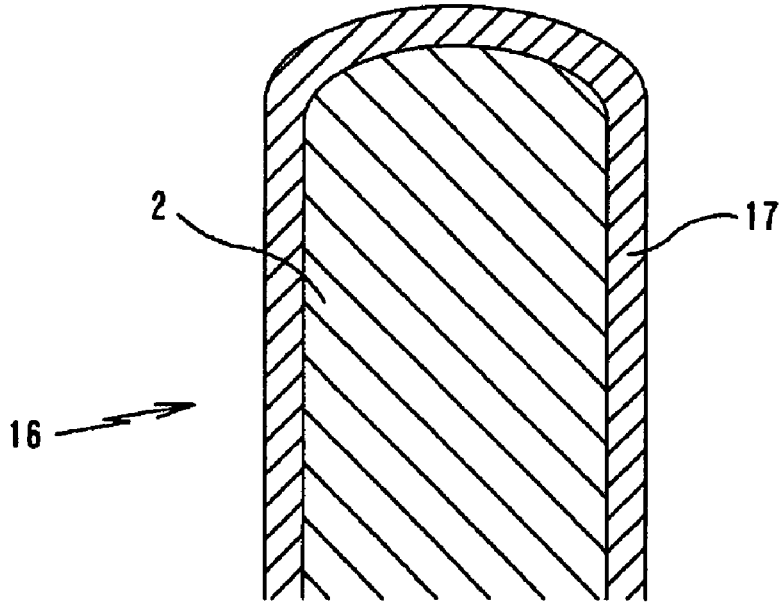
FIGS. 4*a* and 4*b* show cross sectional views of the electronic connector terminal of the present invention formed by punching a thin plate and then applying Au plating thereon.
Figure 4:
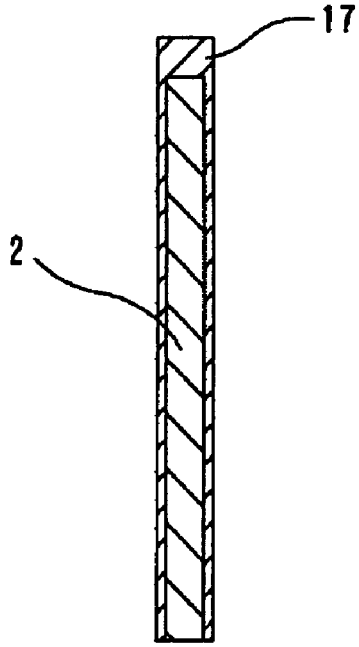

FIG. 4 shows the cross section of the terminal formed by punching the thin plate followed by the Au plating. Here, FIG. 4 shows a part of the terminal in an enlarged format. FIG. 4(*a*) shows the cross section of the terminal 16 viewed from the side facing to the planer part 5 and FIG. 4(*b*) is the cross section of the terminal 16 viewed from the side facing to the lateral part 4. The terminal 16 shown in FIG. 4*b* comprises the Au plating layer 17 which is thicker on the lateral face side 4 and is thinner on the planer part 5 of the terminal base material 2 formed by punching into a desired shape. The ratio of the thicknesses of the Au plating layer 17 is to be from about 10:1 to about 5:1 in preferred embodiments.

In the present invention, the liner plating layer may be disposed between the terminal base material 2 and the Au plating layer 17. In such a case, a ratio of the thicknesses of liner plating layers covering the lateral part 4 and the planer part 5 may be also from about 10:1 to about 5:1 in preferred embodiments.

The above described method comprises only the step of causing the carrier bar 9 to make round trip movements along with the predetermined direction at a predetermined frequency, and hence additional production steps and apparatuses for depositing insulation films are not required. In addition, amounts of Au plating may be largely reduced when comparing with the case in which Au plating with the same thickness is applied because the thickness formed on the wide-area planer part 5 is to be from one tenth to one fifth of the thickness of the lateral part 4.

Advantage of Invention

The electronic connector terminal according to the present invention can be produced easily without requiring the additional production process such as formation of the insulation film on the planer part in order to protect the degradation of the connector performance. The electronic connector terminal of the present invention is also provided in lower costs due to reduced amount of Au necessary for plating and further is able to maintain sufficient contact pressure even when the terminals are placed in a narrow width.

Hereinabove, the present invention has been explained based on the particular embodiments depicted in the drawings, however, a person skilled in the art may appreciate that exclusion of the elements, omissions, other embodiments, and additions may be possible in accordance with the teachings of the above description. The true scope of the present invention will be determined only by claims attached herewith.

What is claimed is:

1. An electronic connector terminal comprising a terminal base material formed by punching a metal thin plate and a gold plating layer covering said terminal base material, said terminal base material further comprising a lateral part having at least one contact and defined as a cut surface of said thin plate through said punching and a planer part defined by front and back faces of a punched-out piece from said thin plate, wherein a thickness of a gold plating layer covering said planer part is thinner than a thickness of a gold plating layer covering said lateral part having said at least one contact.

2. The electronic connector terminal of claim 1, wherein a ratio of said thickness of said gold plating layer covering said lateral part and said thickness of said gold plating layer covering said planer part is to be from about 10:1 to 5:1.

3. The electronic connector terminal of claim 1, wherein said electronic connector terminal comprises a liner plating layer formed between said terminal base material and said gold plating layer so as to cover said terminal base material.

4. The electronic connector terminal of claim 3, wherein a thickness of a liner plating layer covering said planer part is thinner than a thickness of a liner plating layer covering said lateral part having said at least one contact.

5. The electronic connector terminal of claim 3, wherein a ratio of said thickness of said liner plating layer covering said lateral part and said thickness of said liner plating layer covering said planer part is to be from about 10:1 to 5:1.

* * * * *